US012575634B2

(12) United States Patent
Matinifar

(10) Patent No.: US 12,575,634 B2
(45) Date of Patent: Mar. 17, 2026

(54) ELECTRIC POWER GENERATING FOOTWEAR AND METHOD OF CHARGING ELECTRONIC DEVICES

(71) Applicant: Sasan Matinifar, Wilmington, CA (US)

(72) Inventor: Sasan Matinifar, Wilmington, CA (US)

( * ) Notice: Subject to any disclaimer, the term of this patent is extended or adjusted under 35 U.S.C. 154(b) by 91 days.

(21) Appl. No.: 18/603,795

(22) Filed: Mar. 13, 2024

(65) Prior Publication Data

US 2025/0098811 A1 Mar. 27, 2025

Related U.S. Application Data

(60) Provisional application No. 63/585,349, filed on Sep. 26, 2023.

(51) Int. Cl.

| | |
|---|---|
| ***G08B 21/00*** | (2006.01) |
| ***A43B 3/40*** | (2022.01) |
| ***A43B 3/42*** | (2022.01) |

(52) U.S. Cl.
CPC . *A43B 3/42* (2022.01); *A43B 3/40* (2022.01)

(58) Field of Classification Search
CPC .... A43B 3/42; A43B 3/40; A43B 3/35; A43B 3/38
USPC ..... 340/539.1
See application file for complete search history.

(56) References Cited

U.S. PATENT DOCUMENTS

| | | | | |
|---|---|---|---|---|
| 1,506,282 | A | 8/1924 | Barbieri | |
| 6,255,799 | B1 | 7/2001 | Le | |
| 6,281,594 | B1 | 8/2001 | Sarich | |
| 7,977,807 | B1 | 7/2011 | Connor | |
| 2007/0089321 | A1 | 4/2007 | Yeh | |
| 2018/0206586 | A1 | 7/2018 | Akay | |
| 2018/0279714 | A1* | 10/2018 | Deng | H02J 7/00 |
| 2020/0214384 | A1* | 7/2020 | Gruben | A43B 3/36 |
| 2024/0156205 | A1* | 5/2024 | Lee | A43B 3/50 |

* cited by examiner

*Primary Examiner* — Mark S Rushing
(74) *Attorney, Agent, or Firm* — Brennan, Manna & Diamond, LLC

(57) ABSTRACT

The present invention is footwear designed to produce electric power based on the movement of a wearer of the footwear. The footwear includes a kinetic energy generator integrated into the heel of the footwear. A rotor is included in the kinetic energy generator and is adapted to spin in response to the movements of the footwear. A shaft is coupled to the rotor and is configured to perform reciprocal movements to spin the rotor and generate electricity. A charging port is disposed at the rear of the footwear and is configured to receive a power cord such as a USB cable for charging electronic devices. The kinetic energy generator is lightweight and compact and maintains the comfort and usability of the footwear while generating electrical power. The footwear is coupled to a smartphone application for displaying current location, heat map, and electric power generation information of the footwear.

16 Claims, 5 Drawing Sheets

ELECTRIC POWER GENERATING FOOTWEAR AND METHOD OF CHARGING ELECTRONIC DEVICES

CROSS-REFERENCE TO RELATED APPLICATION

The present application claims priority to, and the benefit of, U.S. Provisional Application No. 63/585,349, which was filed on Sep. 26, 2023, and is incorporated herein by reference in its entirety.

FIELD OF THE INVENTION

The present invention generally relates to the field of charging systems for electronic devices. More specifically, the present invention relates to novel footwear designed to utilize body movement to generate electricity. The footwear includes a generator to generate voltage based on the body movement of a user wearing the footwear and provide users with electricity that may be used to charge various items such as a cell phone, flashlight, or other electronic devices. A wireless module couples the footwear with a smartphone application to display the current location of the footwear, heat map of the wearer, and electricity generation information. Accordingly, the disclosure makes specific reference thereto. Nonetheless, it is to be appreciated that aspects of the present invention are also equally applicable to other like applications, devices, and methods of manufacture.

BACKGROUND

By way of background, the human body produces energy of up to 100 joules per second through the process of metabolism, which converts food into energy that can be used for various bodily functions. During metabolism, the human body converts nutrients from food into usable energy and involves breaking down carbohydrates, fats, and proteins to release energy, which is stored in the form of adenosine triphosphate (ATP). One joule per second is equivalent to one watt, so producing 100 joules per second is the same as producing 100 watts of power. 100 joules production is common during moderate to intense physical activity. The amount of energy produced can vary depending on factors such as activity level, body size, and overall health.

However, much of the energy produced by the body during activities such as walking, running, or cycling is dissipated as heat. The energy can also be used for generating electricity for practical use but currently, there is no existing method to convert the energy of the human body into electricity. For example, people often face the challenge of keeping their electronic devices, such as smartphones, charged while on the go, especially where access to power outlets is limited or non-existent, such as during travel or outdoor activities. Solar chargers, hand-crank generators, and power banks have their limitations in terms of convenience, efficiency, and dependability. People desire a system and footwear to capture kinetic energy from human movement and convert it into electricity to potentially allow people to charge their devices through their physical activities.

Therefore, there exists a long-felt need in the art for footwear that utilizes body movement to generate electricity. Additionally, there is a long-felt need in the art for a system that includes a kinetic generator inside footwear to generate electric power through the heat of the feet of a person.

Moreover, there is a long-felt need in the art for footwear that allows users to charge electronic devices from power generated by the footwear. Further, there is a long-felt need in the art of footwear that includes an embedded charging system for charging devices such as flashlights, smartphones, and other small electronics. Furthermore, there is a long-felt need in the art for a charging system that can be integrated into footwear for converting the energy of walking of a user into electricity. Also, there is a long-felt need in the art for footwear that can be paired with a smartphone application for identifying footwear location and power generation. Finally, there is a long-felt need in the art for footwear with an energy harvesting system that offers a way to charge devices such as flashlights, smartphones, and other small electronics.

The subject matter disclosed and claimed herein, in one embodiment thereof, comprises an electricity harvesting footwear. The footwear allows users to charge electronic devices from power generated by the footwear by connecting a charging cord to a charging port disposed on the rear of the footwear. The footwear has a kinetic energy generator integrated into the heel of the footwear. A rotor is integrated within the kinetic energy generator and is adapted to spin in response to the walking movements of a user wearing the footwear to generate electricity. A shaft is coupled to the rotor and is configured to perform reciprocal movements to spin the rotor. The charging port can receive a charging cord to provide the generated electric power for charging electronic devices. The kinetic energy generator is lightweight and compact, maintaining the comfort and usability of the footwear while generating electrical power. A small built-in battery stores electricity generated by the footwear to allow an electronic device to get charged even when the user wearing the footwear is stationary.

In this manner, the footwear with an electric power generating system of the present invention accomplishes all of the foregoing objectives and provides users with footwear designed to utilize body movement to generate electricity. The kinetic generator generates power as a person, while wearing the footwear, walks (i.e., generates movement and heat) through the use of their feet and legs. The footwear allows users to charge electronic devices (i.e., dispense power) from power generated by the footwear by connecting a cable to the back of the heel where a charging port is located. The footwear offers a way to charge devices such as flashlights, smartphones, and other small electronics without requiring any external power supply.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises electricity-generating footwear. The footwear comprising a kinetic energy generator integrated into the heel of the footwear. A rotor is integrated within the kinetic energy generator and is adapted to spin in response to walking movements. A shaft is coupled to the rotor and is configured to perform reciprocal movements to spin the rotor and generate electricity. A charging port is configured to receive a power cord for charging electronic devices with the generated electricity. The kinetic energy generator is lightweight and compact, thereby maintaining the comfort and usability of the footwear while generating electrical power.

In yet another embodiment, an electricity generation system disposed in a footwear for generating electric power to recharge handheld electronic devices is disclosed. The system includes a kinetic energy generator integrated into the heel of the footwear for converting kinetic energy from walking into electrical energy. A wireless module is embedded for pairing the footwear with a user device for remote monitoring and control. A location tracker for tracking location and distance traveled by a user wearing the footwear, wherein the location tracker utilizes electric power generated by the kinetic energy generator. A built-in battery for storing electricity generated by the kinetic energy generator, enabling charging of electronic devices even when the user is stationary. The system can be integrated or installed as an aftermarket accessory in a footwear.

In another embodiment, the kinetic energy generator generates electrical power in a range from about 4V to about 8V and current in the range from about 0.75 A to about 2.5 A.

In yet another embodiment, a method for generating electricity in footwear is described. The method comprising the steps of providing a kinetic energy generator within the footwear, wherein the kinetic energy generator includes a shaft and a rotor, configuring the shaft to mechanically move reciprocally in response to the movement of the footwear, spinning the rotor upon reciprocal movement of the shaft, generating electricity from the spinning rotor, and providing electric power using a charging port to recharge an electronic device.

In another aspect, the method allows for the conversion of kinetic energy from walking into electrical energy within the footwear without significantly altering the conventional function and design of the footwear.

In yet another embodiment, a system for generating electricity in footwear is disclosed. The system includes footwear, a kinetic energy generator integrated into the heel of the footwear for generating electric power, and a wireless module integrated into the footwear for establishing a wireless communication channel with a remote user device. The remote user device is equipped with a monitoring application for displaying parameters related to the footwear. A user interface is displayed in the monitoring application to display the duration and the distance traveled by a user wearing the footwear. The user interface also displays the current location of the footwear on a digital map.

In another aspect of the present invention, the monitoring application displays a heat generation pattern of the feet of a user wearing the footwear, wherein the heat generation pattern is derived from the reciprocal movement of a shaft in the footwear. The heat generation pattern is displayed with varying colors to indicate different temperature zones along the feet.

Numerous benefits and advantages of this invention will become apparent to those skilled in the art to which it pertains upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
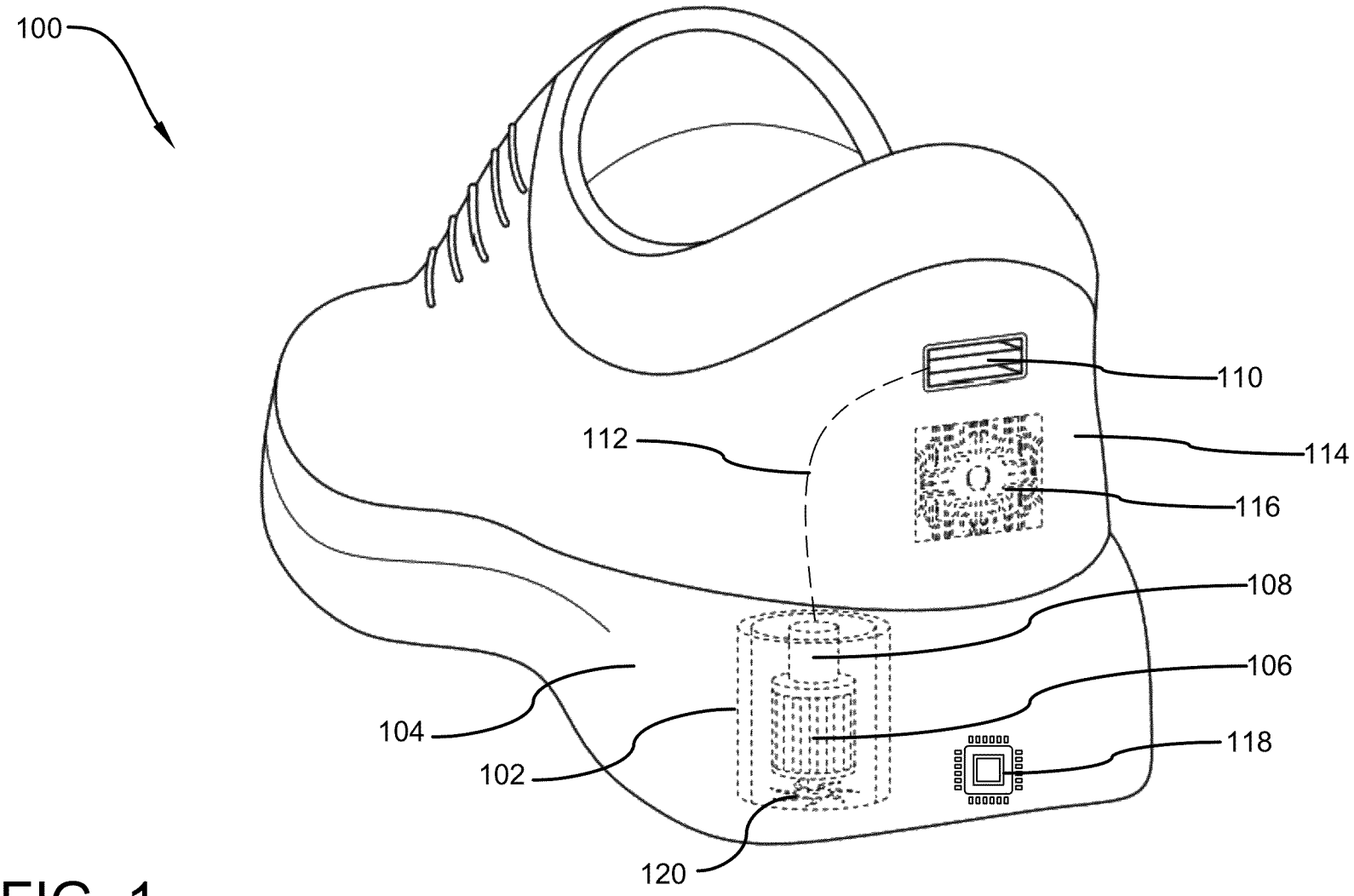
FIG. 1 illustrates a perspective view of one potential embodiment of the footwear with an integrated electricity generator of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for footwear that utilizes body movement to generate electricity. Additionally, there is a long-felt need in the art for a system that includes a kinetic generator inside the footwear to generate electric power through the movements and heat of the feet of a person. Moreover, there is a long-felt need in the art for footwear that allows users to charge electronic devices from power generated by the footwear. Further, there is a long-felt need in the art of footwear that includes an embedded charging system for charging devices such as flashlights, smartphones, and other small electronics. Furthermore, there is a long-felt need in the art for a charging system that can be integrated into footwear for converting the energy of walking and running of a user into electricity. Also, there is a long-felt need in the art for footwear that can be paired with a smartphone application for identifying footwear location and power generation. Finally, there is a long-felt need in the art for footwear with an energy harvesting system that offers a way to charge devices (i.e., dispense energy) such as flashlights, smartphones, and other small electronics.

The present invention, in one exemplary embodiment, is a system for generating electricity in footwear. The system includes footwear, a kinetic energy generator integrated into the heel of the footwear for generating electric power, and a wireless module integrated into the footwear for establishing a wireless communication channel with a remote user device. The remote user device is equipped with a monitoring application for displaying parameters related to the footwear. A user interface is displayed in the monitoring application to display the duration and the distance traveled by a user wearing the footwear. The user interface also displays the current location of the footwear on a digital map. A charging port disposed in the footwear and connected to the generator provides charging to connected electronic devices.

Referring initially to the drawings, FIG. 1 illustrates a perspective view of one potential embodiment of the footwear with an integrated electricity generator of the present invention in accordance with the disclosed structure. The electricity generator equipped footwear 100 of the present invention is designed as conventional footwear and is adapted to convert kinetic energy from walking and running (i.e., movement) into electrical energy. More specifically, the electric energy harvesting footwear 100 includes a kinetic energy generator 102 integrated into heel 104 of the footwear 100. The generator 102 experiences movement and pressure during walking (i.e., transiting) of a user wearing the footwear 100. The generator 102 is lightweight and does not add much weight or bulk to the footwear 100, thereby maintaining the comfort and usability of the footwear 100.

The kinetic energy generator 102 includes a rotor 106 which is adapted to spin when a user wearing the footwear 100 walks or moves. A small shaft 108 is coupled to the rotor 106 wherein the shaft 108 is configured to perform a reciprocal movement when a user wearing the footwear 100 walks or moves. The reciprocal movement of the shaft 108 spins the rotor 106 to generate electricity. The generator 102 is coupled to a charging port 110 which can be a USB, mini-USB, micro-USB, type-C, or any other conventional charging port. The coupling is preferably done using a thin wire 112 which is embedded in the rear part 114 of the footwear 100. The charging port 110 is used for receiving a power cord for charging an electronic device using the electric power generated by the generator 102.

The kinetic energy generator 102 does not impact the functionality of the footwear 100 and generates power in the range from about 4V to about 8V and the current can be in the range from about 0.75 A to about 2.5 A. The generator 102 can withstand the constant impact and stress of walking or running and is further resistant to temperature variations to ensure longevity and functionality in different environments.

Figure 3:
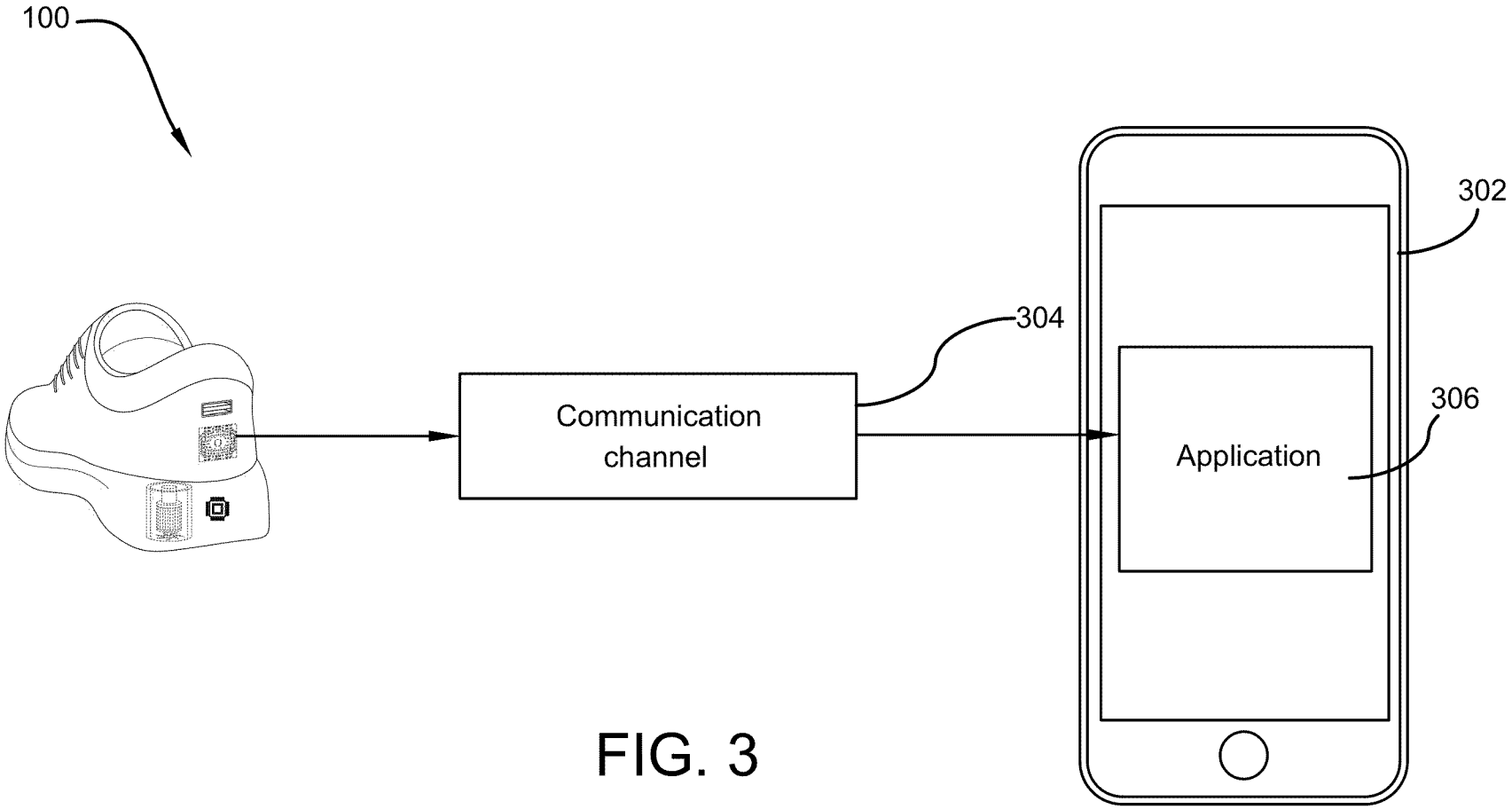
FIG. 3 illustrates a schematic view showing a wireless connection between the footwear equipped with the electricity generation system and a remote user device in accordance with the disclosed architecture.

The footwear 100 includes a wireless module 116 for pairing the footwear 100 to a user device for remote monitoring and control as illustrated in FIG. 3. The wireless module 116 is also embedded in the heel 104 of the footwear 100 and can provide a wireless channel for coupling to the user device. A location tracker 118 such as a GPS tracker is embedded in the footwear 100 for tracking location and the distance travelled by the footwear 100. The GPS tracker 118 is a miniature tracker and may use the electric power generated by the kinetic energy generator 102 for the powering of the location tracker. A small built-in battery 120 stores electricity generated by the footwear 100 for allowing an electronic device to charge even when the user wearing the footwear 100 is stationary.

The footwear 100 can be designed as running shoes, walking shoes, hiking boots, sneakers, children's shoes, sandals, loafers, and any other type of footwear. Further, the heel 104 can be made of rubber, ethylene-vinyl-acetate, thermoplastic-polyurethane, leather, canvas, synthetic fabric, and more. The heel 104 is waterproof to protect the electronic components embedded therein. The damping in the footwear 100 can be designed to meet the requirements of users having different weights.

Figure 2:
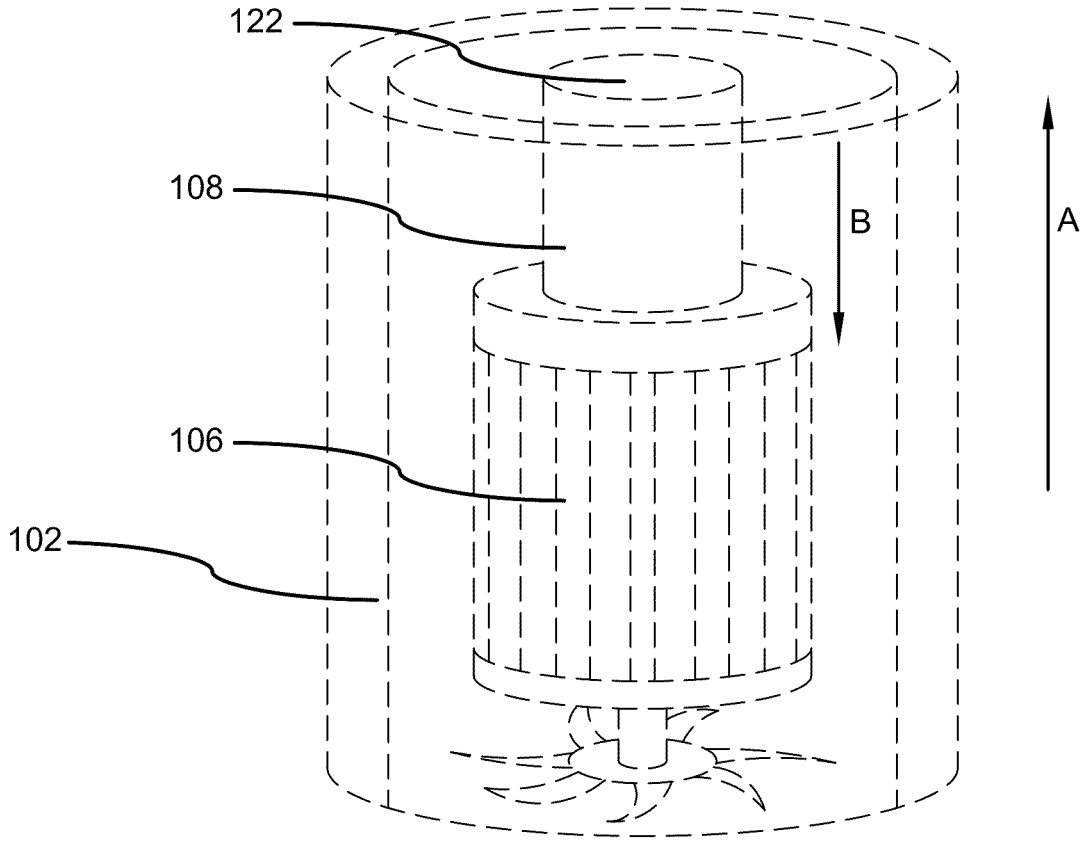
FIG. 2 illustrates an enlarged view of the shaft used in the electricity-generating footwear of the present invention performing reciprocal movement in accordance with the disclosed structure.

FIG. 2 illustrates an enlarged view of the shaft used in the electricity-generating footwear of the present invention performing reciprocal movement in accordance with the disclosed structure. Upon each step of a user wearing the footwear 100, the shaft 108 mechanically moves to spin the rotor 106. More specifically, the shaft 108 reciprocally moves upon movement of the footwear 100 and moves due to the pressure exerted on top of the shaft 108 as illustrated in FIG. 1. The shaft 108 moves in one direction (Arrow B) when a user exerts pressure on the top end 122 of the shaft 108 and moves in opposite direction (Arrow A) when the user releases pressure from the top end 122 of the shaft 108. The pressure also helps in maintaining heat in the shaft 108 for movement and thus, spinning of the rotor 106.

The shaft 108 spins the rotor 106 to generate electricity and may use electromagnetic induction, piezoelectricity, or electrostatic induction. In the preferred embodiment, electromagnetic induction is used by the spinning rotor 106 for generating the electricity. It will be apparent to a person skilled in the art that the kinetic energy generator 102, the shaft 108, and other electronic components can be integrated into a footwear during manufacturing of the footwear or alternatively can be installed as an aftermarket accessory.

FIG. 3 illustrates a schematic view showing a wireless connection between the footwear equipped with the electricity generation system and a remote user device in accordance with the disclosed architecture. The footwear 100 can be coupled with the remote user device 302 using a wireless communication channel 304 established by the wireless module 116. The remote user device 302 can include a monitoring application 306 which can display different parameters of the footwear 100. The wireless communication channel 304 can be a Bluetooth low energy channel, Wi-Fi, NFC, or any other short-range or long-range communication channel.

Figure 4B:
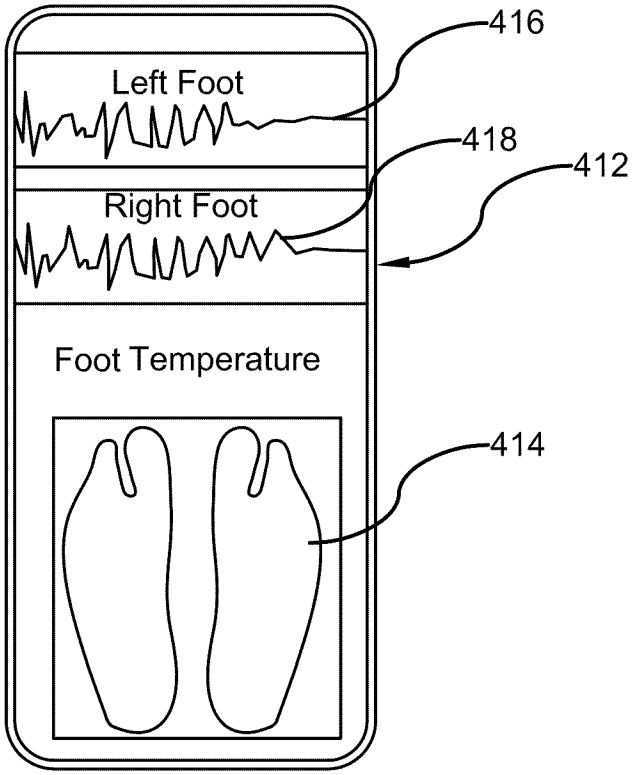
FIGS. 4A and 4B illustrate different user interfaces displayed by the monitoring application in accordance with one embodiment of the present invention.
Figure 4A:
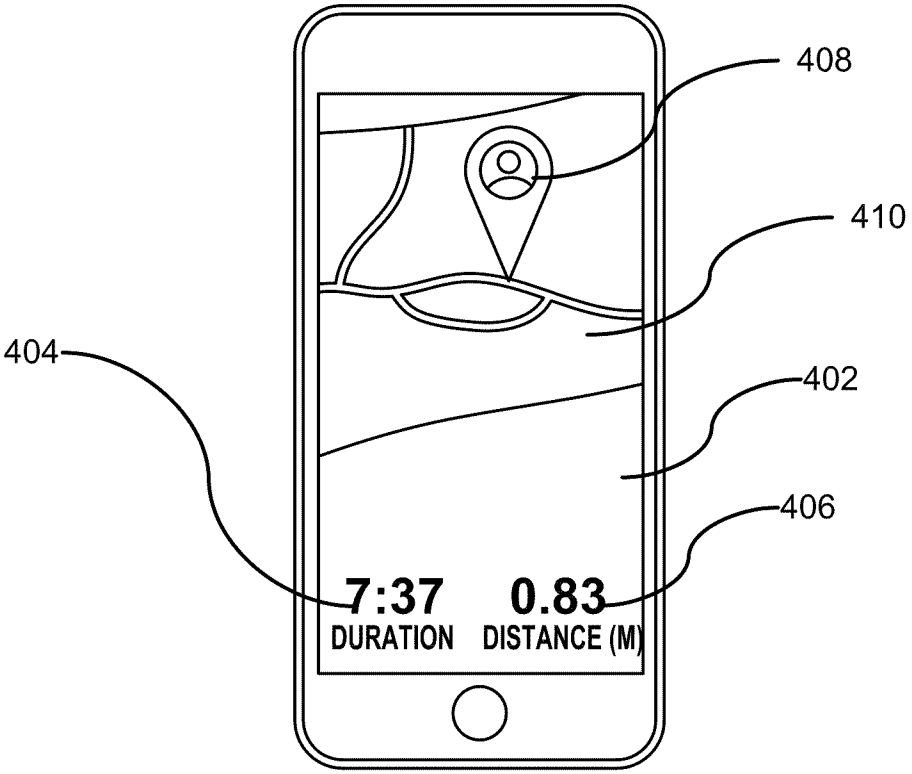

Now referring to FIG. 4A, the user interface 402 of the application 306 displays the duration 404 and the distance 406 (in km or miles) traveled by a user wearing the footwear 100. The distance 406 may be calculated by counting the number of steps of the user. The interface 402 also displays the current location 408 of the footwear 100 and may be displayed on a digital map 410 displayed on the interface 402. The duration 404 and the distance 406 can be reset by the user as per the preferences and requirements.

Referring to FIG. 4B, the application 306 provides the user interface 412 for displaying heat generation pattern 414 of the feet of a user wearing the footwear 100. The heat generation pattern can be derived from the reciprocal movement of the shaft 108 which indicates the pressure on the shaft 108 during movement of the user wearing the footwear 100. The heat generation pattern 414 may display different colors to display the heat pattern along the feet of the user. In one embodiment, the shaft 108 may capture infrared data from the feet of the user, and the captured infrared data can be processed into the heat pattern 414 where the warmer areas of the feet can appear red or orange, and cooler areas can appear blue or green.

The user interface 412 also displays the electricity generation pattern of both the feet of the user. The left foot pattern 416 can display electricity generation variation with respect to time and may be represented in a graphical format which can be customized and configured as per requirements of the user. Similarly, the right foot pattern 418 is also displayed for electricity generation variation with respect to time.

Figure 5:
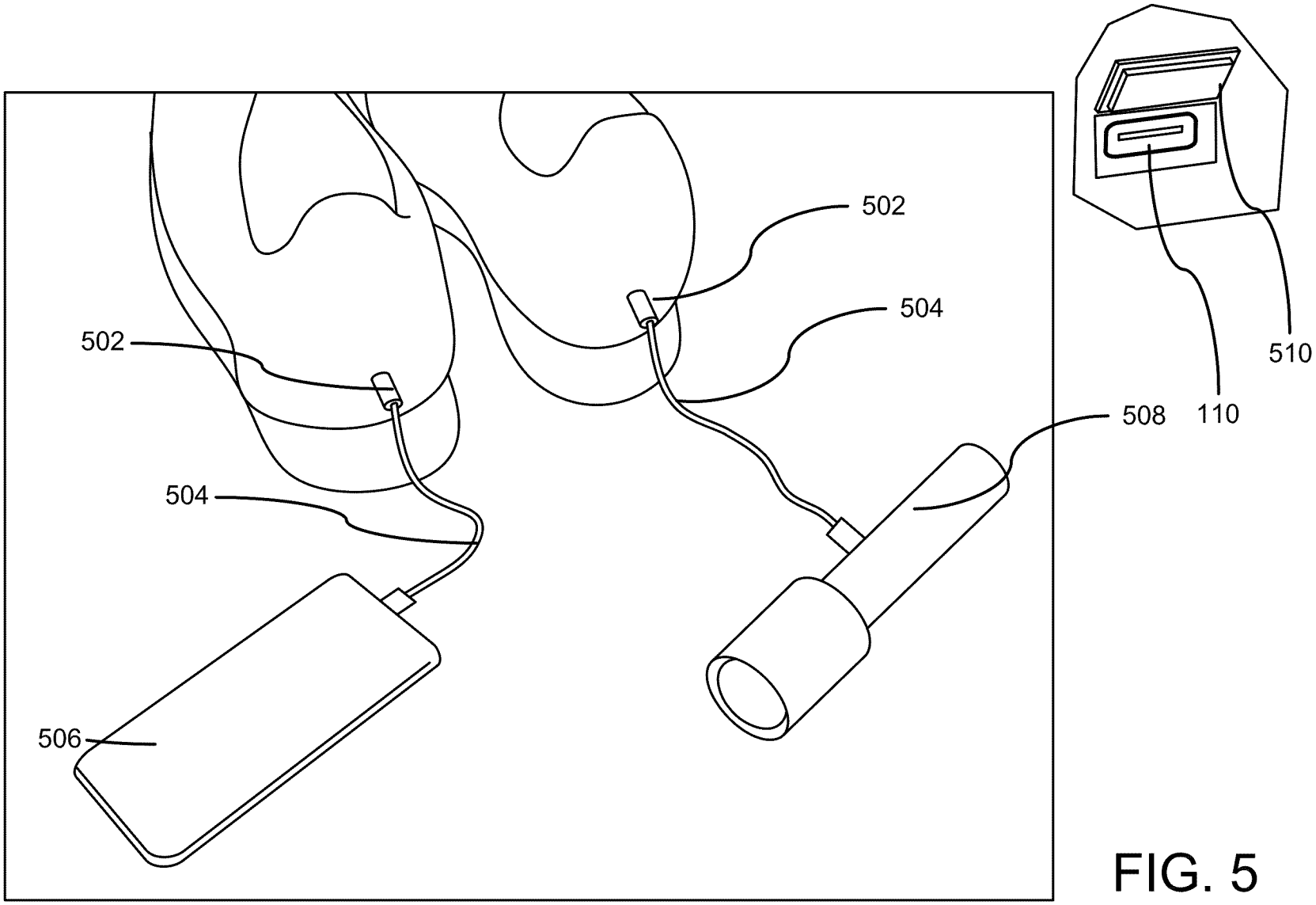
FIG. 5 illustrates a perspective view showing electronic devices connected to the USB port for charging from the footwear in accordance with the disclosed structure.

FIG. 5 illustrates a perspective view showing electronic devices connected to the USB port for charging from the footwear in accordance with the disclosed structure. The charging port 110 can be used for receiving a compatible charging connector 502 of a charging cord 504 for providing recharging to the connected device 506, 508. Any handheld electronic device can be recharged using the footwear 100 by providing electric power in the range of 4V to 8V. For using the charging port 110, the protective cover 510 can be removed and once used, the cover 510 can be used to cover and protect the charging port 110 to prevent debris, dirt, and weather elements from entering the charging port 110.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "electricity-generating footwear", "footwear with integrated electricity generator", "electricity generator equipped footwear", "footwear", and "electric energy harvesting footwear" are interchangeable and refer to the electric energy harvesting footwear 100 of the present invention.

Notwithstanding the foregoing, the electric energy harvesting footwear 100 of the present invention can be of any suitable size and configuration as is known in the art without affecting the overall concept of the invention, provided that it accomplishes the above-stated objectives. One of ordinary skill in the art will appreciate that the electric energy harvesting footwear 100 as shown in the FIGS. are for illustrative purposes only, and that many other sizes and shapes of the electric energy harvesting footwear 100 are well within the scope of the present disclosure. Although the dimensions of the electric energy harvesting footwear 100 are important design parameters for user convenience, the electric energy harvesting footwear 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An electricity generator equipped footwear comprising:
a first shoe and a second shoe;
at least a first kinetic energy generator having a first rotor and a first shaft integrated into a first compressible heel of said first shoe;
a first charging port;
a cover for protecting the first charging port;
wherein said first shaft reciprocates from an extended position to a compressed position in response to steps of a user and to extension and compression of said first compressible heel;
wherein said first shaft reciprocation actuates said first rotor to spin said first rotor around said first shaft;
wherein said first kinetic energy generator coupled to said first charging port;
wherein said first charging port having a first power cord receptacle for receiving a power cord for charging an electronic device;
wherein the first charging port is a type-C charging port; and
wherein movement of said first shoe generates kinetic energy in the at least a first kinetic energy generator and the at least a first kinetic energy generator converts kinetic energy into electrical energy via electrostatic induction.

2. The electricity generator equipped footwear of claim 1, wherein said first shaft reciprocation is up and down.

3. The electricity generator equipped footwear of claim 1, wherein said movement is selected from the group consisting of walking, running, and transiting.

4. The electricity generator equipped footwear of claim 1 further comprising a second kinetic energy generator having a second rotor and a second shaft integrated into a second compressible heel of said second shoe and a second charging port, wherein said second shaft reciprocates from an extended position to a compressed position in response to steps of a user and to extension and compression of said second compressible heel.

5. The electricity generator equipped footwear of claim 4, wherein said second shaft reciprocation actuates said second rotor to spin said second rotor around said second shaft.

6. The electricity generator equipped footwear of claim 5, wherein said second kinetic energy generator coupled to said second charging port.

7. The electricity generator equipped footwear of claim 6, wherein said second charging port having a second power cord receptacle for receiving a power cord for charging an electronic device.

8. An electricity generator equipped footwear comprising:
a first shoe and a second shoe;
a first kinetic energy generator having a first rotor and a first shaft integrated into a first compressible heel of said first shoe;
a first charging port;
a second kinetic energy generator having a second rotor and a second shaft integrated into a second compressible heel of said second shoe;
a second charging port;

a wireless module embedded in the first or second shoe;

an application comprising an interface in communication with the wireless module; and wherein said first shaft reciprocates from an extended position to a compressed position in response to steps of a user and to extension and compression of said first compressible heel;

wherein said first shaft reciprocation actuates said first rotor to spin said first rotor around said first shaft;

wherein said first kinetic energy generator coupled to said first charging port;

wherein said first charging port having a first power cord receptacle for receiving a power cord for charging an electronic device;

wherein said second shaft reciprocates from an extended position to a compressed position in response to steps of a user and to extension and compression of said second compressible heel;

wherein said second shaft reciprocation actuates said second rotor to spin said second rotor around said second shaft;

wherein said second kinetic energy generator coupled to said second charging port;

wherein said second charging port having a second power cord receptacle for receiving a power cord for charging an electronic device;

wherein the first charging port is a mini-USB charging port; and wherein the user interface is configured to display a heat generation pattern of a user's foot.

9. The electricity generator equipped footwear of claim 8, wherein said first shaft reciprocation and said second shaft reciprocation is up and down.

10. The electricity generator equipped footwear of claim 9, wherein movement of said first shoe generates kinetic energy in said first kinetic energy generator, and movement of said second shoe generates kinetic energy in said second kinetic energy generator.

11. The electricity generator equipped footwear of claim 10, wherein said first kinetic energy generator converts kinetic energy into electrical energy and said second kinetic energy generator converts kinetic energy into electrical energy.

12. The electricity generator equipped footwear of claim 11, wherein said movement is selected from the group consisting of walking, running, and transiting.

13. An electricity generator equipped footwear comprising:

a first shoe and a second shoe;

a location tracker;

a first kinetic energy generator having a first rotor and a first shaft integrated into a first compressible heel of said first shoe;

a first charging port;

a second kinetic energy generator having a second rotor and a second shaft integrated into a second compressible heel of said second shoe;

a second charging port;

a wireless module embedded in the first or second shoe;

an application comprising an interface in communication with the wireless module; and wherein said first shaft reciprocates from an extended position to a compressed position in response to steps of a user and to extension and compression of said first compressible heel;

wherein said first shaft reciprocation actuates said first rotor to spin said first rotor around said first shaft;

wherein said first kinetic energy generator coupled to said first charging port;

wherein said first charging port having a first power cord receptacle for receiving a power cord for charging an electronic device;

wherein said second shaft reciprocates from an extended position to a compressed position in response to steps of a user and to extension and compression of said second compressible heel;

wherein said second shaft reciprocation actuates said second rotor to spin said second rotor around said second shaft;

wherein said second kinetic energy generator coupled to said second charging port;

wherein said second charging port having a second power cord receptacle for receiving a power cord for charging an electronic device;

wherein said location tracker embedded in one of said first shoe and said second shoe; and wherein said location tracker powered by one of said first kinetic energy generator and said second kinetic energy generator;

wherein each kinetic energy generator is configured to generate between 4 and 8 volts of power with a current of between 0.75 and 2.5 amperes; and wherein the user interface is configured to display a heat generation pattern of a user's foot.

14. The electricity generator equipped footwear of claim 13 further comprising a battery for storing electrical energy from at least one of said first kinetic energy generator and said second kinetic energy generator for selectively dispensing said stored electrical energy from at least one of said first charging port and said second charging port.

15. The electricity generator equipped footwear of claim 14, wherein movement of said first shoe generates kinetic energy in said first kinetic energy generator, and movement of said second shoe generates kinetic energy in said second kinetic energy generator.

16. The electricity generator equipped footwear of claim 15, wherein said first kinetic energy generator converts kinetic energy into electrical energy and said second kinetic energy generator converts kinetic energy into electrical energy.

* * * * *